US006851139B2

(12) United States Patent
Arason et al.

(10) Patent No.: US 6,851,139 B2
(45) Date of Patent: Feb. 8, 2005

(54) FOLDING CABINET BED

(76) Inventors: Jane A. Arason, 707 Glendon Ave., Annapolis, MD (US) 21403; Jon L. Arason, 707 Glendon Ave., Annapolis, MD (US) 21403

( * ) Notice: Subject to any disclaimer, the term of this patent is extended or adjusted under 35 U.S.C. 154(b) by 0 days.

(21) Appl. No.: 10/699,916

(22) Filed: Nov. 3, 2003

(65) Prior Publication Data

US 2004/0093669 A1 May 20, 2004

Related U.S. Application Data

(60) Provisional application No. 60/423,423, filed on Nov. 4, 2002.

(51) Int. Cl.[7] ..... A47C 17/60

(52) U.S. Cl. ..... 5/159.1; 5/152; 5/4

(58) Field of Search ..... 5/159.1, 151, 152, 5/157, 174, 175, 178, 2.1, 4, 6

(56) References Cited

U.S. PATENT DOCUMENTS

| | | | | | |
|---|---|---|---|---|---|
| 3,792 | A | * | 10/1844 | Kingman | 5/152 |
| 67,816 | A | * | 8/1867 | Stock | 5/152 |
| 83,936 | A | * | 11/1868 | Crosby | 5/152 |
| 85,232 | A | * | 12/1868 | Maynard | 5/152 |
| 95,076 | A | * | 9/1869 | Brander | 5/4 |
| 107,881 | A | * | 10/1870 | Crosby | 5/152 |
| 119,079 | A | * | 9/1871 | Crosby | 5/152 |
| 127,338 | A | * | 5/1872 | Goodrich | 5/156 |
| 151,791 | A | * | 6/1874 | Mendum | 5/152 |
| 157,719 | A | * | 12/1874 | Iverson | 5/152 |
| 179,013 | A | * | 6/1876 | Green | 5/152 |
| 179,513 | A | * | 7/1876 | Burr | 5/169 |
| 186,632 | A | * | 1/1877 | Smith | 5/159.1 |
| 189,303 | A | * | 4/1877 | Crosby | 5/166.1 |
| 201,795 | A | * | 3/1878 | Kiss | 5/4 |
| RE8,375 | E | * | 8/1878 | Kiss | 5/4 |
| 218,678 | A | * | 8/1879 | Koskul | 5/152 |
| 239,805 | A | * | 4/1881 | Knapp | 5/159.1 |
| 253,903 | A | * | 2/1882 | Witmer | 5/152 |
| 306,894 | A | * | 10/1884 | Balke | 5/4 |
| 309,111 | A | * | 12/1884 | Van Slyke | 5/152 |
| 310,343 | A | * | 1/1885 | Warren | 5/152 |
| 322,177 | A | * | 7/1885 | Goode | 5/152 |
| 1,170,149 | A | * | 2/1916 | Gustafson | 5/157 |
| 2,356,321 | A | * | 8/1944 | Irick | 5/152 |
| 3,638,249 | A | * | 2/1972 | Katsigarakis | 5/159.1 |

FOREIGN PATENT DOCUMENTS

| | | | | |
|---|---|---|---|---|
| BE | 537992 | * | 5/1955 | 5/151 |
| FR | 921179 | * | 4/1947 | 5/174 |
| FR | 1084476 | * | 1/1955 | 5/2 |
| FR | 1369358 | * | 7/1964 | 5/4 |
| GB | 2103 | * | 1/1893 | 5/4 |
| GB | 726249 | * | 3/1955 | 5/4 |
| IT | 534716 | * | 10/1955 | 5/151 |

* cited by examiner

*Primary Examiner*—Robert G. Santos
(74) *Attorney, Agent, or Firm*—Whiteford, Taylor & Preston, LLP; Jeffrey C. Maynard; Gregory M. Stone

(57) ABSTRACT

A folding cabinet bed is described for providing a piece of furniture that opens to a full-length bed in an attractive chest with a small footprint. The invention comprises a cabinet that houses a mattress, such as a futon, and allows the futon to be deployed as a bed. The cabinet is deep and tall enough to enclose a folded futon and of sufficient width to accommodate standard sizes of futon mattresses, without a separate mattress platform. Hinges on the bottom of the front and back walls of the cabinet enable the cabinet to be opened vertically so that the front and back walls fold down to a sleeping position, without mechanical devices to assist in deploying the bed. The top of the cabinet can become a headboard for the bed in the open configuration. Decorative handles or other protrusions on the front and back walls of the cabinet are sized to extend outward from the cabinet the same distance as the feet/supports of the cabinet to create a level sleeping surface when unfolded. Latching means holds the cabinet securely closed to withstand the outward pressure of the folded futon.

27 Claims, 10 Drawing Sheets

FOLDING CABINET BED

CROSS REFERENCE TO RELATED APPLICATION

This application is based upon and claims benefit of now abandoned and co-owned U.S. Provisional Patent Application Ser. No. 60/423,423 entitled "Fu-Chest", filed with the U.S. Patent and Trademark Office on Nov. 4, 2002 by the inventors herein, the specification of which is incorporated herein by reference.

BACKGROUND OF THE INVENTION

1. Field of the Invention

The present invention relates to furniture and more particularly pertains to a cabinet that can house a folding futon mattress and allows the futon to be deployed as a bed.

2. Ground of the Prior Art

The broad concept of a cabinet bed is not new. However, prior cabinet beds tended to suffer from one or more of several disabilities; for example bulky and un-prepossessing appearance, complicated mechanism rendering it difficult to fold and unfold the bed and compounding its costs, significant lack of comfort, and other problems.

U.S. Pat. No. 3,638,249 to Katsigarakis discloses a cabinet bed having a box mounted on a base. The front and back panels are hinged to the base to permit the box to be opened to reveal a bed within. In operation, the box has a flap on the front and back that extends when the box is opened to support the bed. The bed includes an articulated spring mattress support that unfolds with the front and back panels to form the bed.

U.S. Pat. No. 431,825 to Sundback discloses a folding bed having pivoted front and back panels. The invention concentrates on a spring roller assembly that aids in the opening and closing operation of the bed cabinet.

U.S. Pat. No. 5,611,414 to Walker discloses a self-contained folding bed. A foldable mattress is stored inside a suitcase enclosure. The suitcase may be a soft body or hard shell case and may include bed clothing as well as cushioning within.

U.S. Pat. No. 3,965,498 to Boni and U.S. Pat. No. 2,788,528 to Hansen disclose a folding bed assembly designed to be stored within an upright cabinet. Support means fold out of the bedspring frame to provide legs. Hinged support members assist in folding the bed for storage within the cabinet.

U.S. Pat. No. 3,858,253 to Lauzon discloses a piece of furniture that is designed to be convertible to a bed. An upper panel of the furniture is hinged to permit the panel to be pivoted downward to constitute the base of the bed. Springs attached to the pivoting panel assist in raising and lowering the bed portion.

While each of the above-mentioned devices may be effective to some degree in providing a folding bed, none of the references, however, disclose a simple cabinet with few moving parts, that can open to reveal a thin futon mattress and does not require a separate mattress support.

SUMMARY OF THE INVENTION

The present invention provides a solution to the above and other problems by enabling a simply designed, easy to construct, folding cabinet bed that provides an attractive piece of furniture that opens to a full-length bed.

It is, therefore, an object of the present invention to enable a folding cabinet bed that avoids the disadvantages of the prior art.

It is another object of the present invention to enable a folding cabinet bed that is compact and easy to construct. A related object is to enable a folding cabinet bed that presents a decorative appearance in the closed configuration.

It is another object of the present invention to enable a folding cabinet bed having a simple design. It is a related object of the present invention to enable a folding cabinet bed having no separate mattress platform internal to the cabinet. A further related object of the present invention is to enable a folding cabinet bed in which the cabinet top becomes a headboard in the open configuration. A still further related object of the present invention is to enable a folding cabinet bed wherein the decorative cabinet hardware is sized to work in conjunction with the cabinet feet to create a raised level platform in the open configuration.

It is another object of the present invention to enable a folding cabinet bed comprising removable side panels, such that the bed is safe and attractive in the open configuration.

It is another object of the present invention to enable a folding cabinet bed that can be securely latched when closed to withstand the outward pressure of the folded futon. It is a related object of the present invention to enable a folding cabinet bed that has no mechanical devices to assist in deploying the bed to an open configuration.

It is another object of the present invention to enable a folding cabinet bed that may be easily and efficiently manufactured and marketed. A related object of the present invention is to enable a folding cabinet bed that is susceptible of a low cost of manufacture with regard to both materials and labor, and which accordingly is then susceptible of low prices of sale to the consuming public, thereby making such a folding cabinet bed economically available to the buying public.

It is another object of the present invention to enable a folding cabinet bed comprising an attractive cabinet enclosure and a futon mattress.

In accordance with the above and other objects, a folding cabinet bed is described for providing a piece of furniture that opens to a full-length bed in Ian attractive chest with a small footprint. The invention comprises a cabinet that houses a mattress, such as a futon, and allows the futon to be deployed as a bed. The cabinet is deep and tall enough to enclose a folded futon and of sufficient width to accommodate standard sizes of futon mattresses, without a separate mattress platform. Hinges on the bottom of the front and back walls of the cabinet enable the cabinet to be opened vertically so that the front and back walls fold down to a sleeping position, without mechanical devices to assist in deploying the bed. The top of the cabinet can become a headboard for the bed in the open configuration. Decorative handles or other protrusions on the front and back walls of the cabinet are sized to extend outward from the cabinet the same distance as the feet/supports of the cabinet to create a level sleeping surface when unfolded. Latching means holds the cabinet securely closed to withstand the outward pressure of the folded futon.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
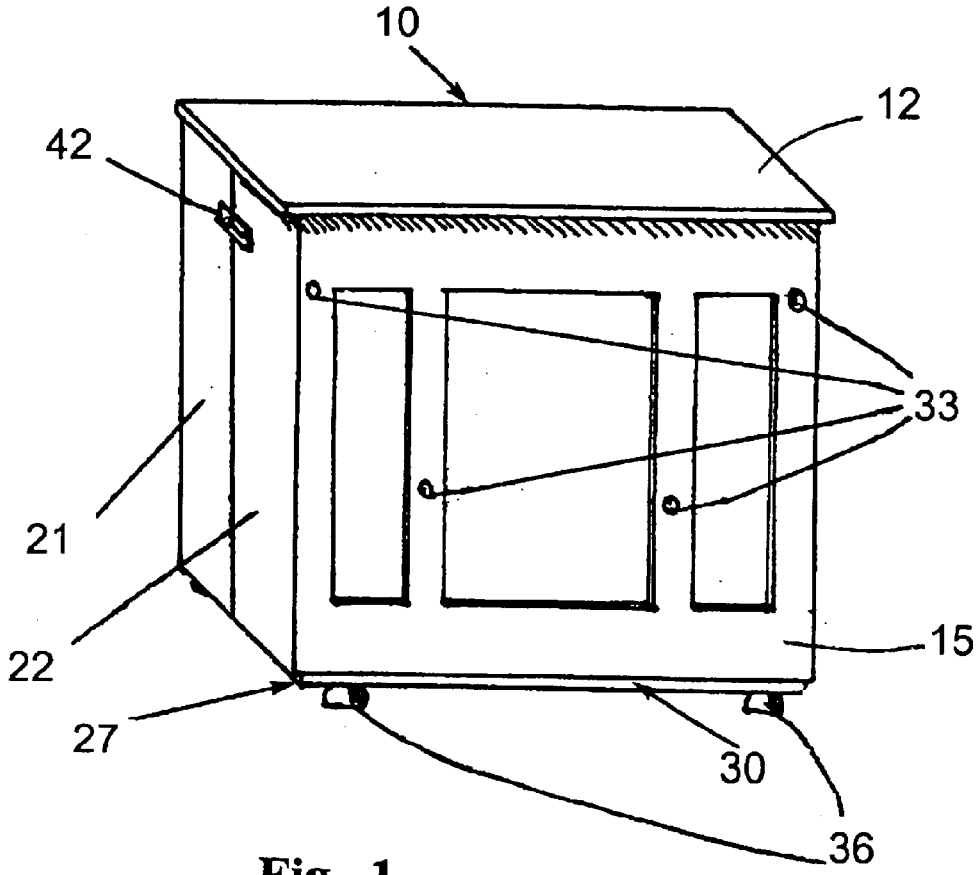
FIG. 1 illustrates a front perspective view of a folding cabinet bed according to one embodiment of the present invention.
Figure 2:
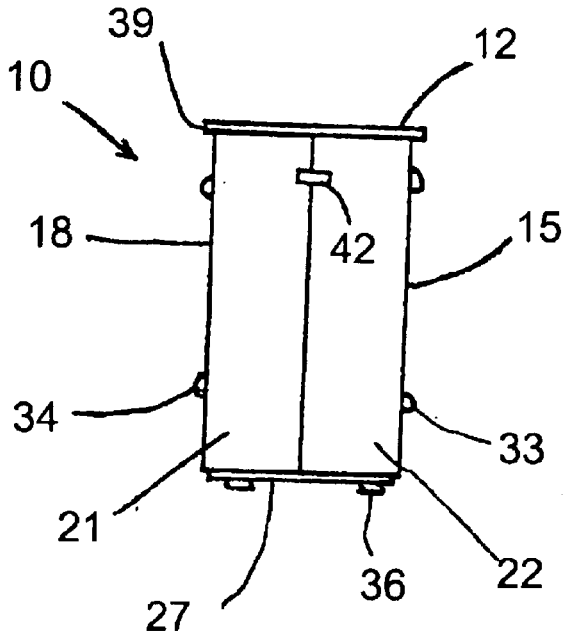
FIG. 2 illustrates a side elevational view of the folding cabinet bed in the closed configuration according to one embodiment of the present invention.
Figure 3:
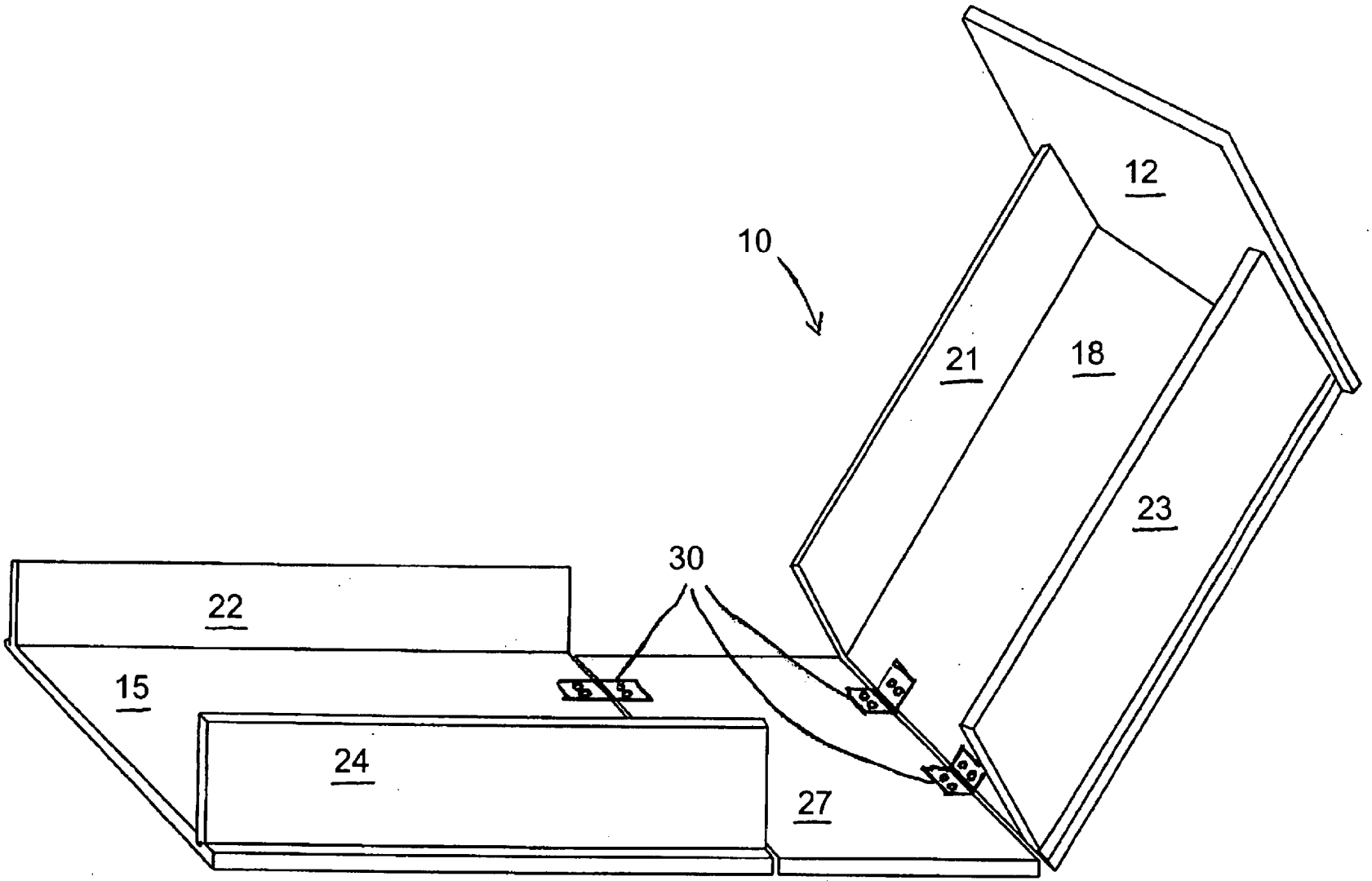
FIG. 3 illustrates a perspective view of the folding cabinet bed in the open configuration according to one embodiment of the present invention.
Figure 4:
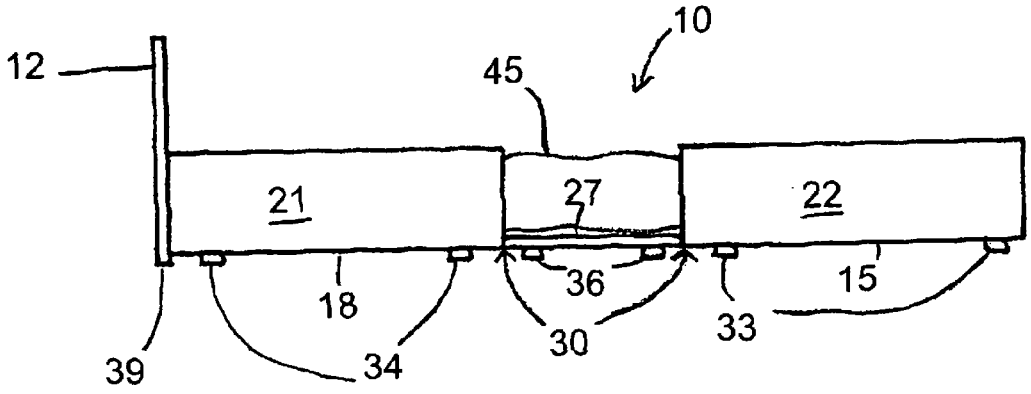
FIG. 4 illustrates a side elevational view of the folding cabinet bed in the open configuration according to one embodiment of the present invention.

Referring to FIGS. 1–4, a cabinet of the present invention, indicated generally as 10, is constructed of solid wood, plywood, wood laminate, MDF, particleboard, or other common furniture construction materials. The cabinet 10 comprises a top panel 12, front wall 15, back wall 18, sidewalls 21, 22, 23, 24, and base 27. In one embodiment, top panel 12 is attached to back wall 18 and the top edge of sidewalls 21, 23, only. In another embodiment, top panel 12 is attached to front wall 15 and the top edge of sidewalls 22, 24, only. The invention is described herein with reference to the embodiment in which top panel 12 is attached to the back wall 18. It is understood that such other embodiment is included, as well. Front wall 15 is pivotably attached to the front edge of base 27 by one or more hinges 30 at the bottom of front wall 15. Back wall 18 is pivotably attached to the back edge of base 27 by one or more hinges 30 at the bottom of back wall 18, as shown in FIG. 3. Such hinges 30 may be attached to the edges of front wall 15, back wall 18, and base 27 instead of the broad surface of such panels.

A plurality of knobs 33 protrude from the front wall 15 and a plurality of cleats 34 protrude from the back wall 18. A plurality of supports 36 are attached to the bottom surface of base 27. Each knob 33 and each cleat 34 protrudes the same distance from the surface of the front wall 15 and back wall 18, respectively, as the distance the supports 36 extend from the base 27. Furthermore, the edge 39 of top panel 12 overlaps back wall 18 the same distance the support 36 extends from the base 27. In an open configuration, the distal ends of the knobs 33, cleats 34, and the edge 39 of top panel 12 fall in the same plane as the bottom of support 36 such that front wall 15, back wall 18, and base 27 form a common plane above the floor or surface upon which cabinet 10 is placed in the open configuration.

A pair of latching mechanisms 42, 43 connects sidewalls 21, 22 and 23, 24 respectively, near the top portion of such sidewalls. Such latching mechanisms 42, 43 hold the sidewalls 21, 22, and 23, 24 adjacent to each other in the closed configuration.

In a preferred embodiment, the cabinet 10 of the present invention is sized and configured to enable a futon 45 to be enclosed within such cabinet 10. Cabinet 10 can be configured to hold a single-size, full-size, or queen-size futon and may optionally include space for one or more pillows and bedclothes. Front wall 15 may be decorated to present an attractive appearance for a false cabinet or to mimic a piece of furniture, such as a chest of drawers, credenza, bureau, dresser, and the like.

Figure 5:
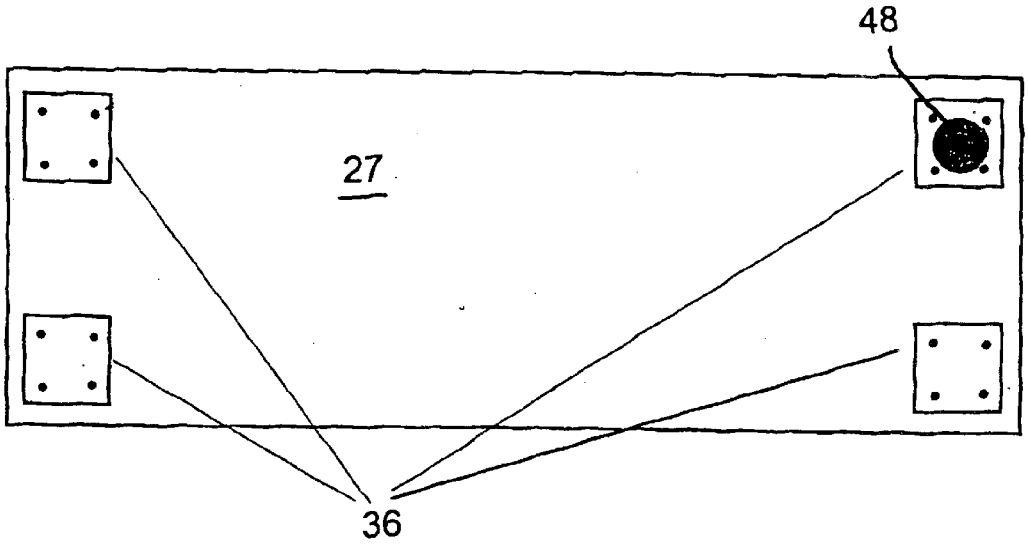
FIG. 5 illustrates a bottom plan view of the folding cabinet bed according to one embodiment of the present invention.

Referring to FIG. 5, a plurality of supports 36 are attached to the bottom surface of base 27, generally near the corners of such base 27. Each such support 36 may further comprise a slider 48, caster, wheel, or the like. Such slider 48 may be made of plastic, Teflon, felt, or like material.

Figure 6:
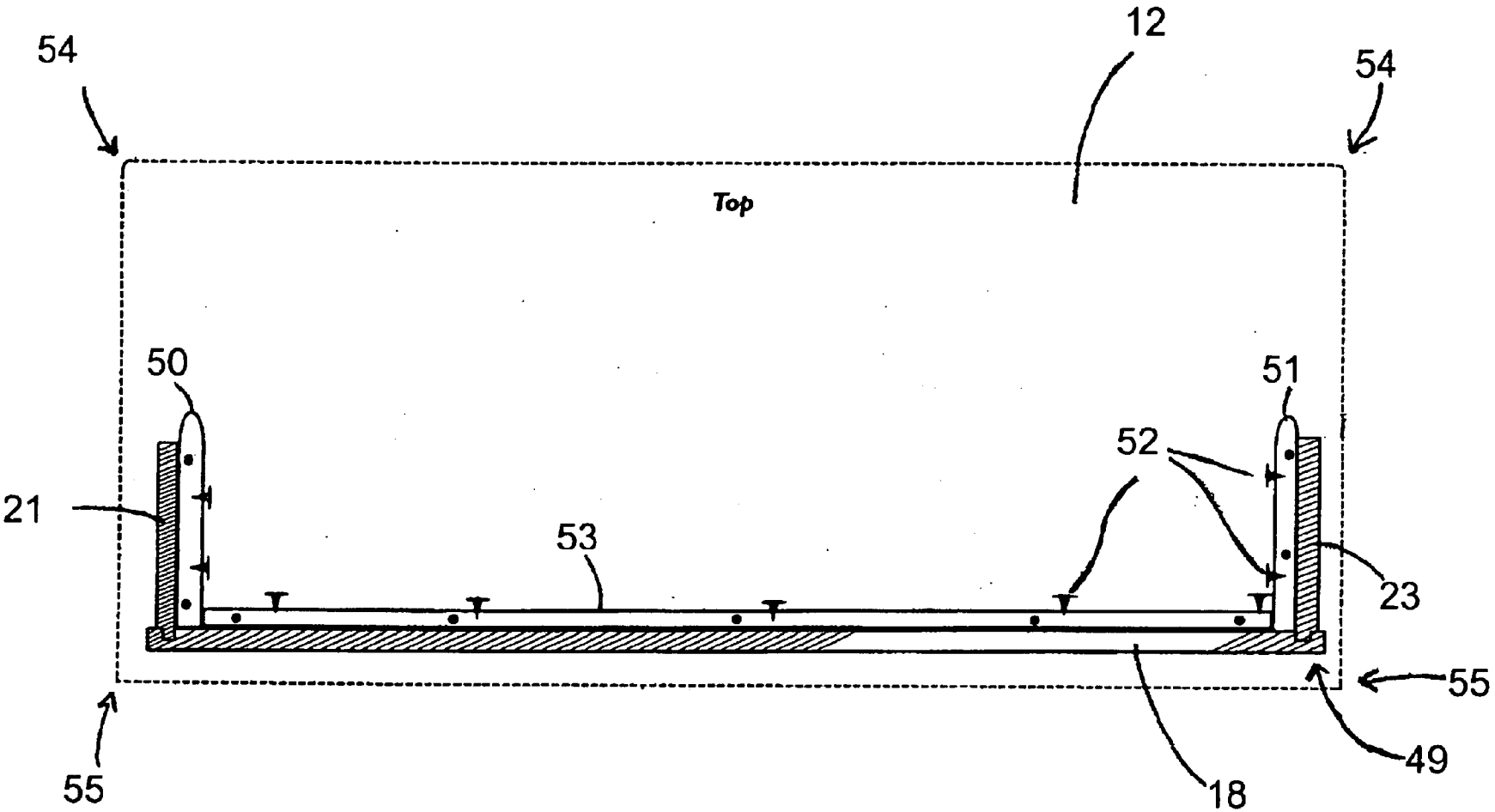
FIG. 6 illustrates a plan view of internal guide members of the folding cabinet bed, according to one embodiment of the present invention.

FIG. 6 shows an internal view of top panel 12 showing the connections to back wall 18 and sidewalls 21, 23. As is conventional in the art, sidewalls 21, 23 may be attached to back wall 18 by dovetailing or notching the pieces together with tongue and groove, as shown at 49. A suitable adhesive, such as wood glue and the like may be used. To connect top panel 12 to back wall 18 and sidewalls 21, 23, internal reinforcements may be used. Guide cleats 50, 51 are firmly attached to sidewalls 21, 23 and top panel 12 using suitable fasteners, such as a plurality of screws 52. Such guide cleats 50, 51 are slightly longer than sidewalls 21, 23 and have a rounded end for ease of fitment against sidewalls 22, 24 when the cabinet 10 is in the closed configuration. Additionally, back wall 18 is connected to top panel 12 using an elongated two-way cleat 53. Such elongated two-way cleat 53 can be connected at the intersection of such back wall 18 and top panel 12 using suitable fasteners, such as a plurality of screws 52. Other types of fasteners may also be used, such as cam locks that are not visible and may eliminate the need for some of the internal reinforcements.

It should be pointed out that the exposed corners 54 of top panel 12 (those corners facing toward front wall 15 when cabinet 10 is in the closed configuration and facing up when cabinet 10 is in the open configuration) should be rounded to form a smooth corner. The opposite corners 55 of top panel 12 (those corners closest to back panel 18 and that rest on the floor when cabinet 10 is in the open configuration) should be square corners.

Figure 7:
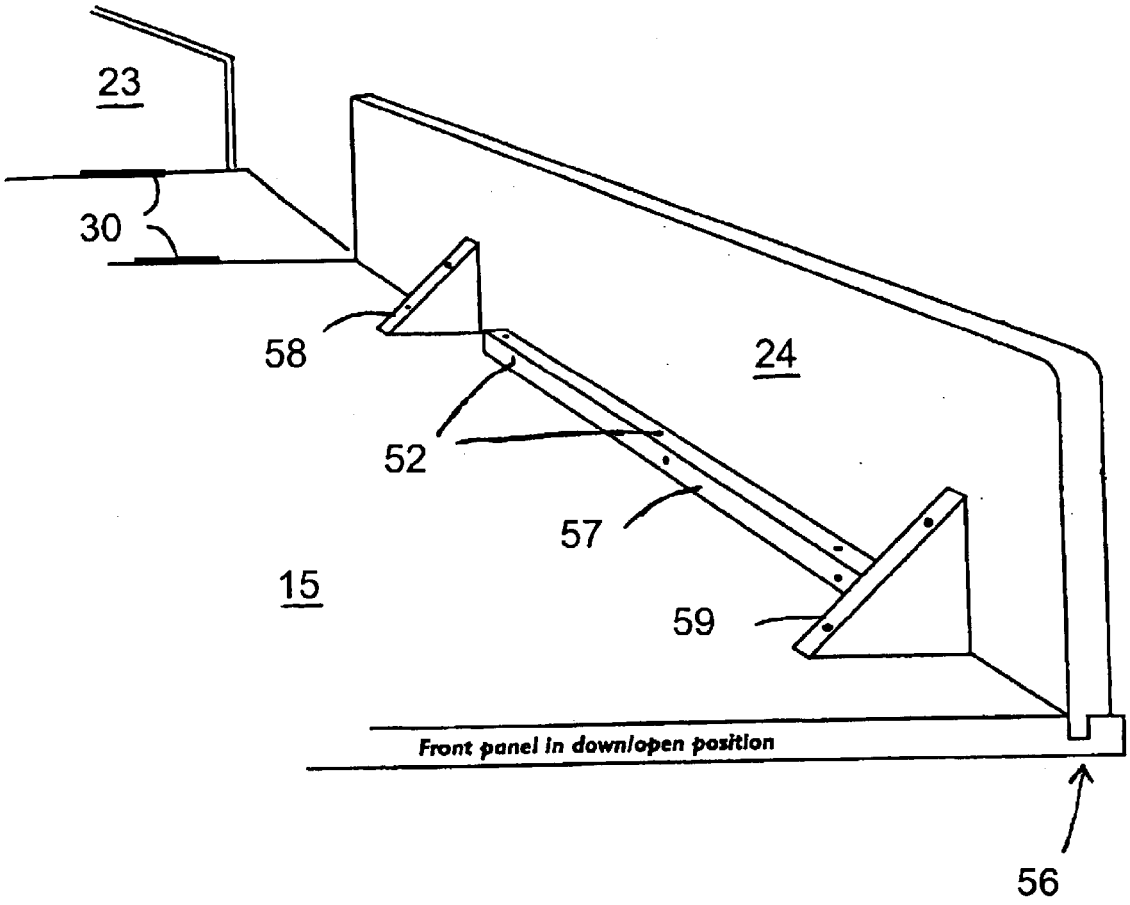
FIG. 7 illustrates a partial view of internal reinforcements of the folding cabinet bed, in perspective, according to one embodiment of the present invention.

FIG. 7 shows a partial view of front wall 15 in an open position. As is conventional in the art, sidewall 24 may be attached to front wall 15 by dovetailing or notching the pieces together with tongue and groove, as shown at 56. A suitable adhesive, such as wood glue and the like may be used. Internal reinforcements may be used to provide strength for the sidewalls 22, 24. Such reinforcements may include elongated connector piece 57 that can be connected at the intersection of such front wall 15 and sidewall 24. Connector piece 57 is firmly attached to sidewall 24 and front wall 15 using suitable fasteners, such as a plurality of screws 52. Angled brackets 58, 59 are attached to an inner surface of front wall 15 and sidewall 24, respectively. In an alternate embodiment, angle irons or L-brackets, as are known in the art, can be used. Other types of fasteners may also be used, such as cam locks that are not visible and may eliminate the need for some of the internal reinforcements.

Figures 8A, 8B, 8C:
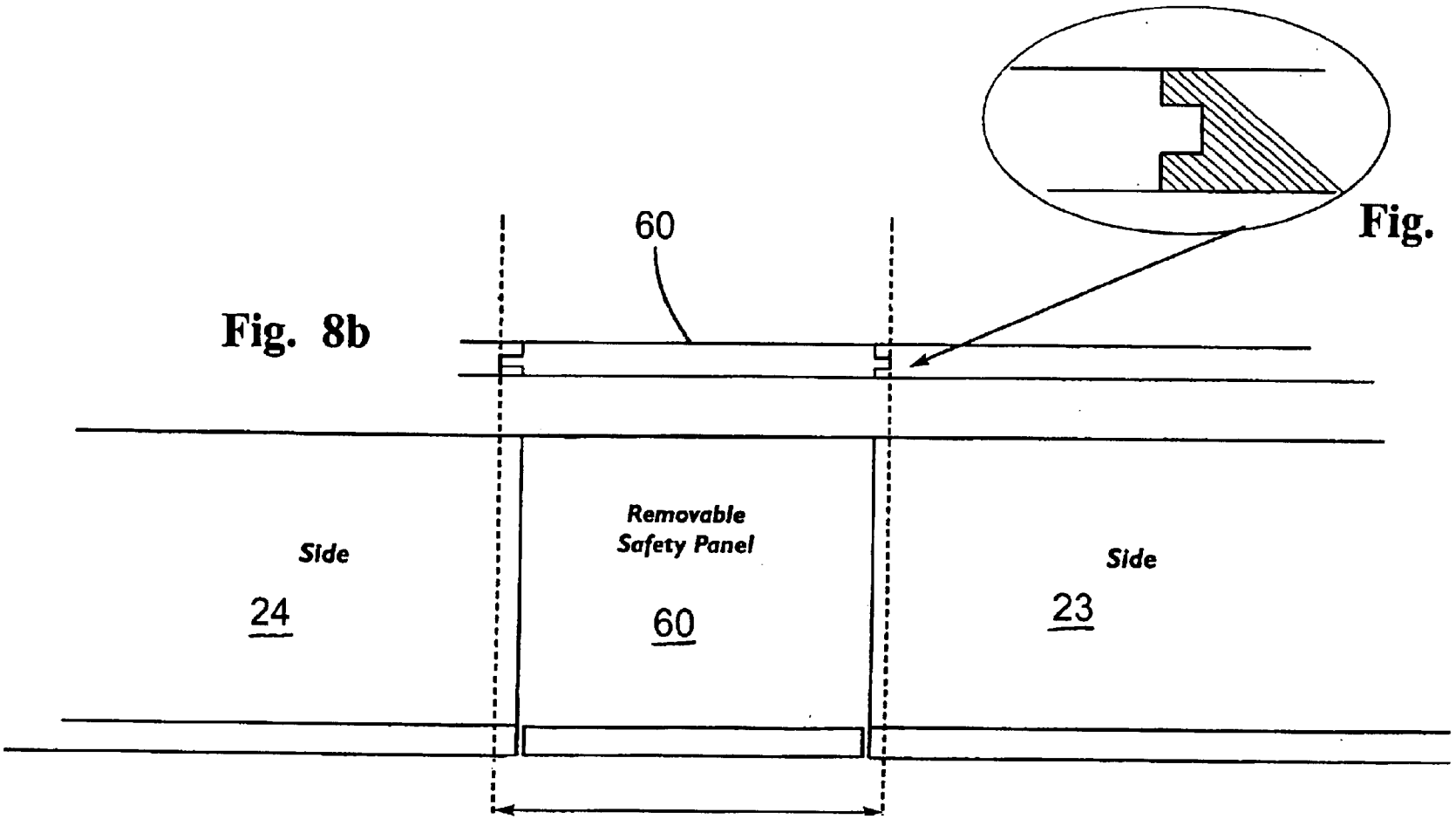
FIG. 8*a* illustrates a partial side elevational view of sidewalls of the folding cabinet bed showing additional features of the present invention.
FIG. 8*b* illustrates a top plan view of the sidewalls of FIG. 8*a;*
FIG. 8*c* illustrates an enlarged fragmentary view of a portion of FIG. 8*b;*

In some embodiments, a removable safety panel can be inserted between the sidewalls, when front wall 15 and back wall 18 are in the open position. FIG. 8*a* shows a removable safety panel 60 installed between sidewalls 23, 24. It is understood that a similar removable safety panel can be installed between sidewalls 21, 22. Removable safety panel 60 is sized and configured to fit in the space between the sidewalls 23, 24 including whatever space may be necessary due to the hinges 30. In a preferred embodiment, removable safety panel 60 is configured with an edge profile such as a tongue on each side to conveniently fit in complementary groove profiles in the ends of sidewalls 23, 24, as shown in FIGS. 8*b* and 8*c*. It should be obvious that the grooved ends of sidewalls 23, 24 are at the bottom of such sidewalls when the cabinet 10 is in the closed configuration.

Figure 9:
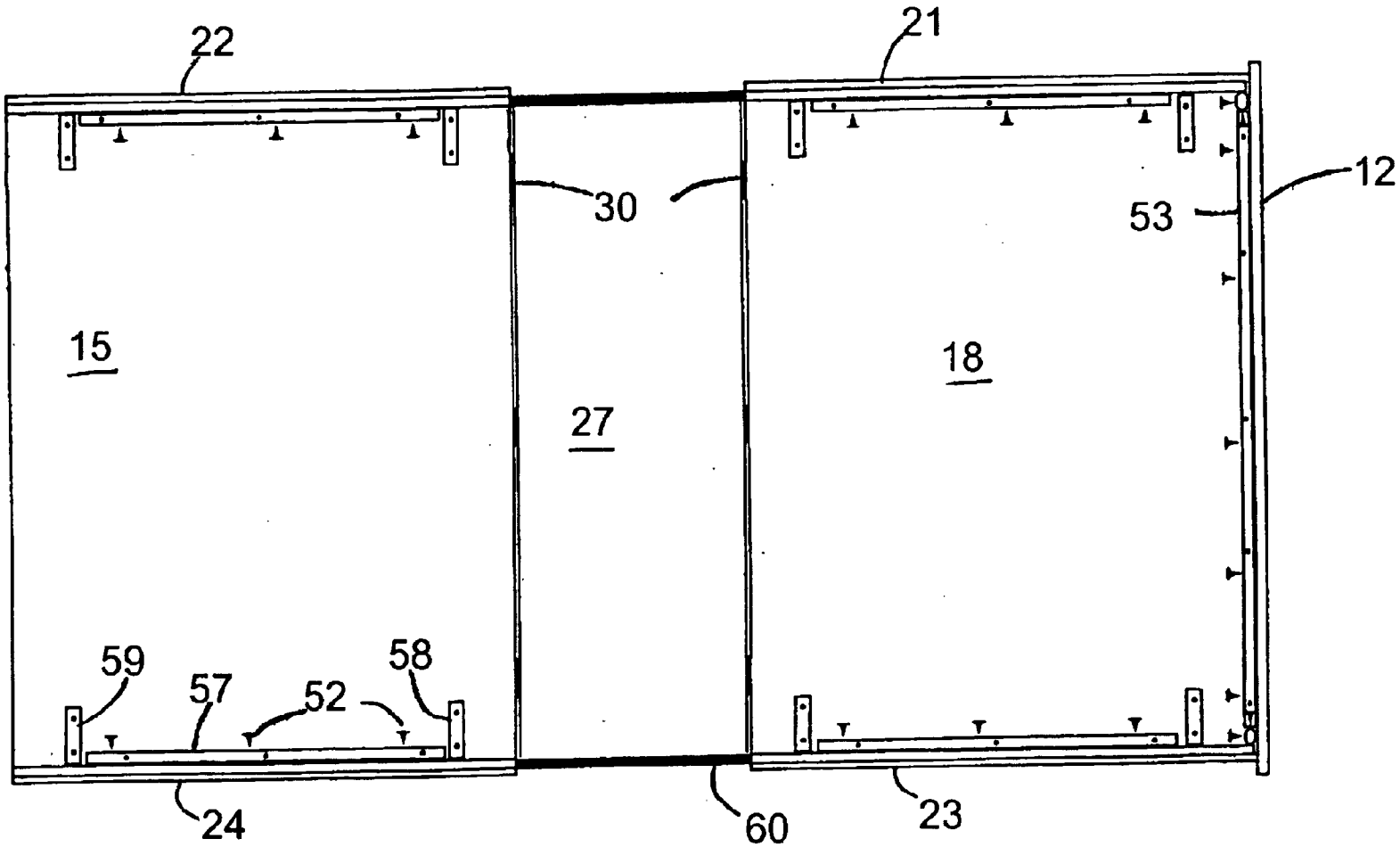
FIG. 9 illustrates a top plan view of the folding cabinet bed in the open configuration according to one embodiment of the present invention.

In use, cabinet 10 can be opened vertically from top to bottom by releasing latching mechanisms 42, 43 and permitting the front wall 15 and back wall 18 to fold down to expose futon 45, and to allow the futon 45 to open to a sleeping position. In an open configuration, such as shown in FIG. 9, top panel 12 becomes the headboard for the bed.

Figure 10:
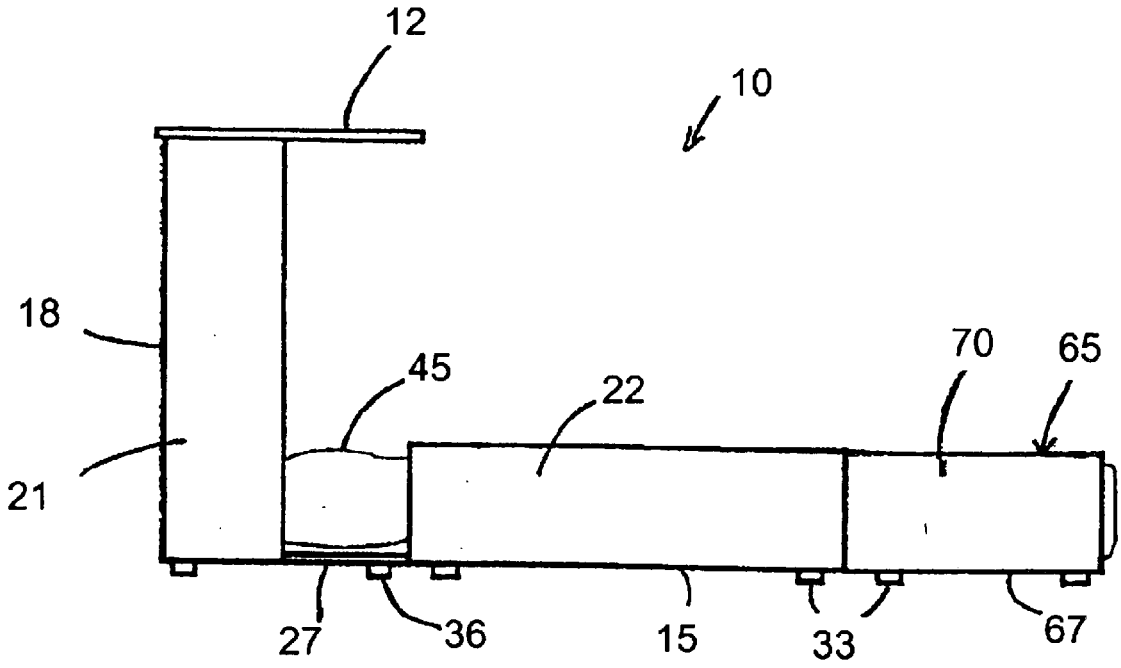
FIG. 10 illustrates a side elevational view of the folding cabinet bed in the open configuration according to an alternate embodiment of the present invention.

In an alternate embodiment, the folding cabinet 10 can be assembled in an alternate folding option, as shown in FIG. 10. In this embodiment, cabinet 10 comprises a top panel 12, front wall 15, back wall 18, sidewalls 21, 22, 23, 24, and base 27. Top panel 12 is attached to back wall 18; back wall 18 is rigidly attached to the back edge of base 27; and the bottom edges of sidewalls 21, 23 are rigidly attached to base 27. Only front wall 15 is pivotably attached to the front edge of base 27 by one or more hinges at the bottom of front wall 15. An extension, indicated generally as 65, is pivotably attached to the free end of the front wall 15 by one or more hinges. Extension 65 comprises a bottom panel 67 and sidewalls 70, 71.

Extension 65 is sized and configured such that the spacing between sidewalls 70, 71 is slightly narrower than the spacing between sidewalls 22, 24 so that extension 65 can fit inside such sidewalls 22, 24 and nest within the enclosure formed by top panel 12, back wall 18, and sidewalls 21, 22, in the closed configuration. Sidewalls 70, 71 can be reinforced in a similar fashion as described with reference to FIG. 7.

A plurality of knobs 33 protrude from the front wall 15 and the bottom panel 67 of the extension 65. A plurality of supports 36 are attached to the bottom surface of base 27. Each knob 33 protrudes the same distance from the surface of the front wall 15 and bottom panel 67 as the distance the supports 36 extend from the base 27. In an open configuration, the distal ends of the knobs 33 fall in the same plane as the bottom of support 36 such that front wall 15, bottom panel 67, and base 27 form a common plane above the floor or surface upon which cabinet 10 is placed.

In use, cabinet 10 can be opened vertically from top to bottom. First, latching mechanisms 42, 43 are released. Then front wall 15 folds down and extension 65 is folded out to expose futon 45 to allow the futon 45 to open to a sleeping position. In an open configuration, back wall 18 becomes the headboard, with top panel 12 overhanging. In such alternate embodiment, the cabinet 10 need not be moved away from a wall to open and extend futon 45 to a full-sized bed.

Figures 11, 13:
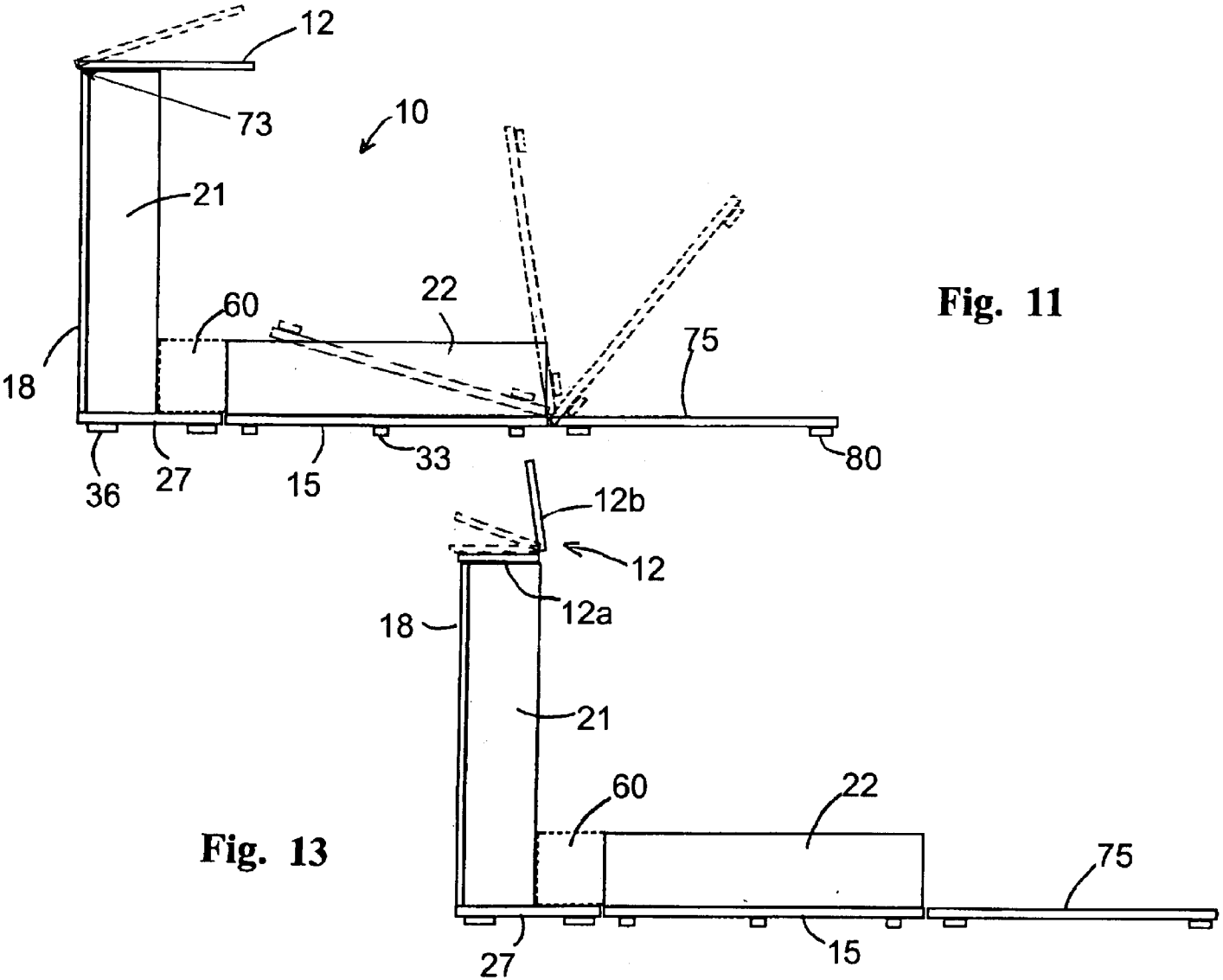
FIG. 11 illustrates a side elevational view of the folding cabinet bed in the open configuration according to another alternate embodiment of the present invention.
FIG. 13 illustrates a side elevational view of the folding cabinet bed of FIG. 11 showing additional features.
Figure 12:
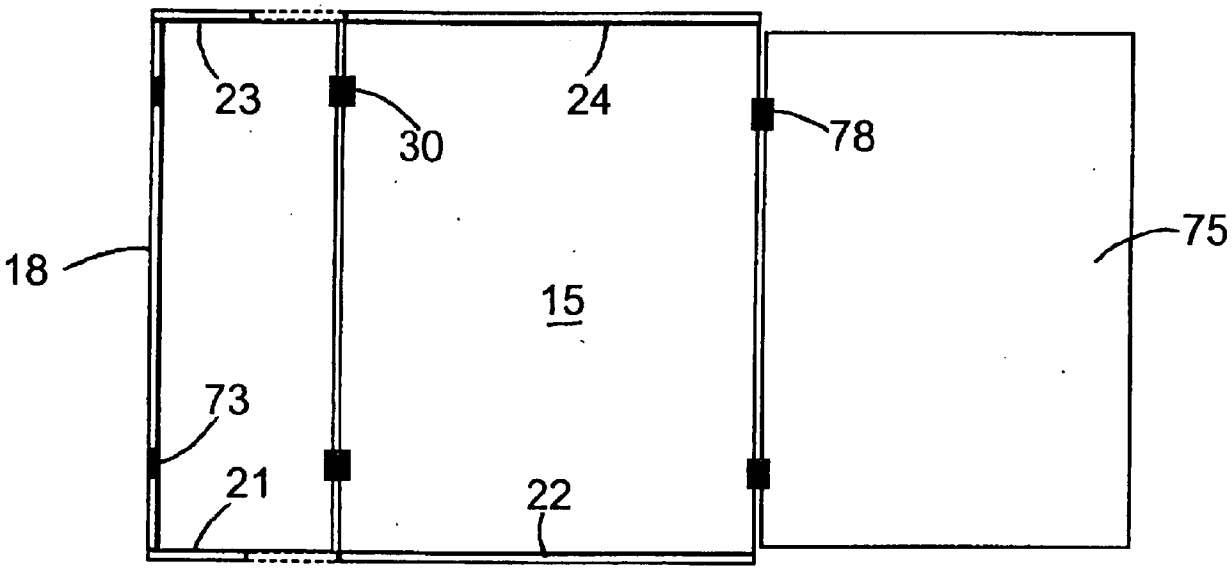
FIG. 12 illustrates a top plan view of the folding cabinet bed in the open configuration according to the alternate embodiment of FIG. 11.

Referring to FIGS. 11 and 12, an alternate embodiment of cabinet 10 comprises a top panel 12, front wall 15, back wall 18, sidewalls 21, 22, 23, 24, and base 27. Back wall 18 is rigidly attached to the back edge of base 27 and the bottom edges of sidewalls 21, 23 are rigidly attached to base 27. Front wall 15 is pivotably attached to the front edge of base 27 by one or more hinges 30 at the bottom of front wall 15. Top panel 12 is pivotably attached to back wall 18 using one or more hinges 73. The top edges of sidewalls 21, 23 are not attached to top panel 12. When front wall 15 is moved to the open position, top panel 12 can be rotated on hinge 73 to enable clearance for sidewalls 22, 24.

An extension panel 75 is pivotably attached to the free end of the front wall 15 by one or more hinges 78, as shown in FIG. 12. Extension panel 75 is sized and configured to fit between sidewalls 22, 24 so that extension panel 75 can fit inside such sidewalls 22, 24 in the closed configuration. There are no sidewalls on extension panel 75, which enables extension panel 75 to fit flush against the inner surface of front wall 15 when cabinet 10 is in the closed configuration.

A plurality of knobs 33 protrude from the front wall 15 and a plurality of supports 36 are attached to the bottom surface of base 27. Each knob 33 protrudes the same distance from the surface of the front wall 15 as the distance the supports 36 extend from the base 27. Additional projections 80, on the outer surface of extension panel 75, also protrude the same distance from the outer surface of extension panel 75 as the distance the supports 36 extend from the base 27. In an open configuration, the distal ends of the knobs 33 and projections 80 fall in the same plane as the bottom of support 36 such that front wall 15, extension panel 75, and base 27 form a common plane above the floor or surface upon which cabinet 10 is placed.

FIG. 13 illustrates an alternate embodiment for top panel 12. In this embodiment, cabinet 10 comprises a top panel 12, front wall 15, back wall 18, sidewalls 21, 22, 23, 24, and base 27. Top panel 12 comprises two pieces: back piece 12*a*, which is rigidly attached to back wall 18 and the top edge of sidewalls 21, 23, and front piece 12*b*, which is pivotably attached to back piece 12*a* using one or more hinges. When front wall 15 is moved to the open position, the front piece 12*b* of top panel 12 can be lifted to enable clearance for sidewalls 22, 24.

Figure 14:
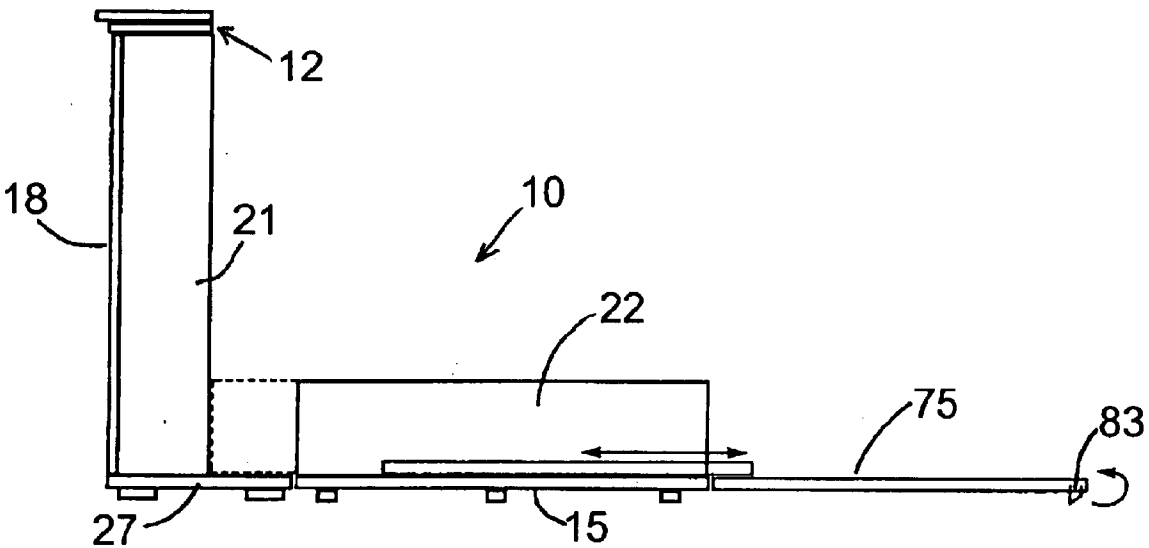
FIG. 14 illustrates a side elevational view of the folding cabinet bed in the open configuration according to a further alternate embodiment of the present invention.

FIG. 14 shows an alternate embodiment for deployment of extension panel 75. In this embodiment, cabinet 10 comprises a top panel 12, front wall 15, back wall 18, sidewalls 21, 22, 23, 24, base 27, and extension panel 75. Extension panel 75 may be slidably connected to the inner surfaces of sidewalls 22, 24 or to the inner surface of the front wall 15, by appropriate slides. Extension panel 75 is sized and configured to fit between sidewalls 22, 24 so that extension panel 75 can fit inside such sidewalls 22, 24 in the closed configuration. In some embodiments, there are no sidewalls on extension panel 75.

In use, cabinet 10 can be opened vertically from top to bottom. First, latching mechanisms 42, 43 are released. Then front wall 15 folds down and extension panel 75 is slid out, parallel to front wall 15, to allow the futon 45 (FIGS. 4 and 10) to open to a sleeping position. At the end of its travel, extension panel 75 drops down to form a common plane with front wall 15. A pivoting bar 83, at the distal end of extension panel 75, is rotated to support the end of extension panel 75 such that front wall 15, extension panel 75, and base 27 form a common plane above the floor or surface upon which cabinet 10 is placed.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A folding cabinet bed, without a separate mattress platform, said folding cabinet bed comprising:

a base;

a top panel;

a back wall having a first end, a second end, and two longitudinal side edges, hingedly attached at said first end to said base;

first and second spaced-apart sidewalls, wherein a. said back wall is connected to said first and second sidewalls at said longitudinal side edges;

b. said back wall is connected to said top panel at said second end of said back wall;

c. said first and second sidewalls are connected at a top end to said top panel; and d. said first and second sidewalls are not connected to said base;

a front wall having a first end, a second end, and two longitudinal side edges, hingedly attached at said first end to said base;

third and fourth spaced-apart sidewalls, wherein a. said front wall is connected to said third and fourth sidewalls at said longitudinal side edges; and b. said third and fourth sidewalls are not connected to said base;

a futon mattress, wherein 1. said front wall and said back wall are selectively movable between a closed position and an open position;

2. said futon is enclosed within said folding cabinet bed when said front wall and said back wall are in the closed position: and 3. said safety side panels fit between the spaced apart sidewalls attached to said front wall and the snaced apart sidewalls attached to said back wall when said front wall and said back wall are in the open position.

2. The folding cabinet bed of claim 1, further comprising:

a plurality of feet mounted to the bottom side of said base, wherein each of said feet extends a predetermined distance from the bottom of said base and each of said feet extends the same predetermined distance.

3. The folding cabinet bed of claim 2, further comprising:

a plurality of knobs mounted to an outer surface of said front wall, wherein each of said knobs extends a predetermined distance from the surface of said front wall equal to the distance said feet extend from the bottom of said base.

4. The folding cabinet bed of claim 2, further comprising:

a plurality of cleats mounted to an outer surface of said back wall, wherein each of said cleats extends a predetermined distance from the surface of said back wall equal to the distance said feet extend from the bottom of said base.

5. The folding cabinet bed of claim 2, wherein said top panel overlaps said back wall equal to the distance said feet extend from the bottom of said base.

6. The folding cabinet bed of claim 1, wherein said front wall and said back wall cooperate with said base to form a level sleeping platform when said front wall and said back wall are in the open position.

7. The folding cabinet bed of claim 6, wherein said level sleeping platform is raised off the floor.

8. The folding cabinet bed of claim 1, further comprising means to hold said sidewalls adjacent to each other when said front wall and said back wall are in the closed position.

9. The folding cabinet bed of claim 1, further comprising means to keep said sidewalls aligned when said front wall and said back wall are moving to the closed position and when said front wall and said back wall are in the closed position.

10. The folding cabinet bed of claim 1, wherein said front wall is decorated to mimic a piece of furniture selected from the group consisting of:

a. chest of drawers;

b. credenza;

c. bureau; and d. dresser.

11. The folding cabinet bed of claim 1, said sidewalls having a profile therein, said safety side panel further comprising a complementary profile adapted to enable said safety side panel to engage said sidewall profile when said front wall and said back wall are in the open position.

12. A folding cabinet bed, without a separate mattress platform, said folding cabinet bed comprising:

a base;

a top panel;

a back wall having a first end, a second end, and two longitudinal side edges, attached at said first end to said base;

first and second spaced-apart sidewalls, wherein a. said back wall is connected to said first and second sidewalls at said longitudinal side edges;

b. said back wall is connected to said top panel at said second end of said back wall; and c. said first and second sidewalls are connected at a bottom end to said base;

a front wall having a first end, a second end, and two longitudinal side edges, hingedly attached at said first end to said base;

third and fourth spaced-apart sidewalls, wherein a. said front wall is connected to said third and fourth sidewalls at said longitudinal side edges; and b. said third and fourth sidewalls are not connected to said base;

an extension comprising:

a bottom panel, narrower than said front wall; and a futon mattress, wherein 1. said front wall is selectively movable between a closed position and an open position;

2. said extension is selectively movable between a closed position and an open position;

3. said extension is sized and configured to enable said bottom panel to fit between said third and fourth sidewalls when said front wall and said extension are in the closed position; and 4. said futon is enclosed within said folding cabinet bed when said front wall is in the closed position.

13. The folding cabinet bed of claim 12, further comprising:

a plurality of feet mounted to the bottom side of said base, wherein each of said feet extends a predetermined distance from the bottom of said base and each of said feet extends the same predetermined distance.

14. The folding cabinet bed of claim 13, further comprising:

a plurality of knobs mounted to an outer surface of said front wall, wherein each of said knobs extends a predetermined distance from the surface of said front wall equal to the distance said feet extend from the bottom of said base.

15. The folding cabinet bed of claim 12, wherein said top panel is hingedly connected to said second end of said back wall.

16. The folding cabinet bed of claim 12, said top panel further comprising:

a first section rigidly connected to said second end of said back wall, wherein said first and second sidewalls are connected at a top end to said first section; and a second section hingedly attached to said first section.

17. The folding cabinet bed of claim 12, said bottom panel having a first end, a second end, and two longitudinal side edges, wherein said bottom panel is hingedly attached at said first end to said second end of said front wall.

18. The folding cabinet bed of claim 17, further comprising fifth and sixth spaced-apart sidewalls, wherein said bottom panel is connected to said fifth and sixth sidewalls at said longitudinal side edges.

19. The folding cabinet bed of claim 12, wherein said bottom panel is slidably connected to said front wall.

20. The folding cabinet bed of claim 12, wherein said bottom panel is slidably connected to said third and fourth spaced-apart sidewalls.

21. The folding cabinet bed of claim 14, wherein said front wall and said extension cooperate with said base to form a level sleeping platform when said front wall is in the open position.

22. The folding cabinet bed of claim 21, wherein said level sleeping platform is raised off the floor.

23. The folding cabinet bed of claim 12, further comprising means to hold the sidewalls attached to said front wall and the sidewalls attached to said back wall adjacent to each other when said front wall is in the closed position.

24. The folding cabinet bed of claim 12, further comprising means to keep said sidewalls aligned when said front wall is moving to the closed position and when said front wall is in the closed position.

25. The folding cabinet bed of claim 12, wherein said front wall is decorated to mimic a piece of furniture selected from the group consisting of:

a. chest of drawers;

b. credenza;

c. bureau; and d. dresser.

26. The folding cabinet bed of claim 12, further comprising:

a pair of safety side panels that fit between the spaced apart sidewalls attached to said front wall and the spaced apart sidewalls attached to said back wall when said front wall is in the open position.

27. The folding cabinet bed of claim 26, said sidewalls having a profile therein, said safety side panel further comprising a complementary profile adapted to enable said safety side panel to engage said sidewall profile when said front wall is in the open position.

* * * * *